United States Patent [19]

Salice

[11] Patent Number: 4,742,599

[45] **Date of Patent: * May 10, 1988**

[54] HINGE BRACKET AND FASTENING PLATE ASSEMBLY FOR USE IN A FURNITURE HINGE

[75] Inventor: Luciano Salice, Carimate, Italy

[73] Assignee: Arturo Salice S.p.A., Novedrate (Como), Italy

[ * ] Notice: The portion of the term of this patent subsequent to Jun. 23, 2004 has been disclaimed.

[21] Appl. No.: 873,765

[22] Filed: Jun. 12, 1986

[30] Foreign Application Priority Data

Jun. 12, 1985 [DE] Fed. Rep. of Germany ..... 3521051

[51] Int. Cl.[4] ..... E05D 5/00

[52] U.S. Cl. ..... 16/382; 16/258

[58] Field of Search ..... 16/382, 238, 240, 241, 16/245, 246, 370, 257, 259, 235, 242, 254, 257, 258, 383, 387

[56] References Cited

U.S. PATENT DOCUMENTS 4,674,148 6/1987 Salice ..... 16/382

FOREIGN PATENT DOCUMENTS 7432793 4/1975 Fed. Rep. of Germany .
2839576 3/1980 Fed. Rep. of Germany .
3345063 6/1985 Fed. Rep. of Germany .

*Primary Examiner*—Frederick R. Schmidt
*Assistant Examiner*—Maurina Rachuba
*Attorney, Agent, or Firm*—Fleit, Jacobson, Cohn & Price

[57] ABSTRACT

A hinge bracket and fastening plate assembly for a furniture hinge in which a hinge bracket is securely held relative to a fastening plate in order to provide firm interconnection therebetween and to prevent any longitudinal backlash from taking place. The tight connection is achieved by a pivotal detent lever that is spring biased to cause an eccentrically curved cam face to engage with an abutment edge on a stationary fastening plate, and thereby draw a hinge bracket set screw into tight engagement with a corresponding slot in the fastening plate.

5 Claims, 3 Drawing Sheets

FIG. 6
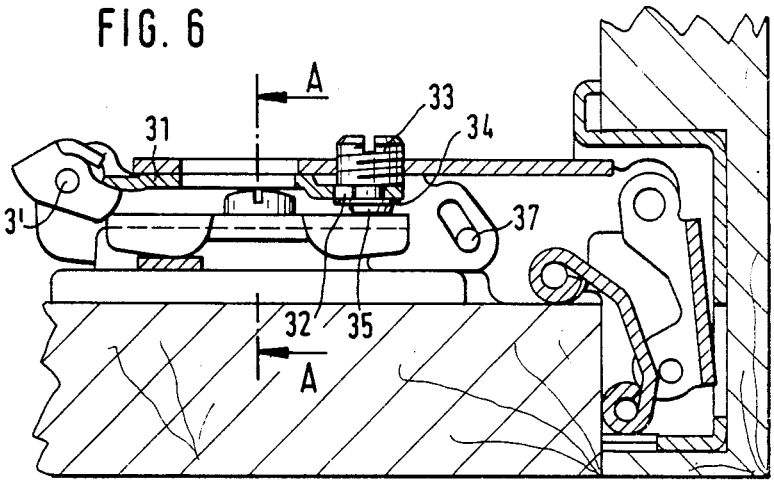
FIG. 7
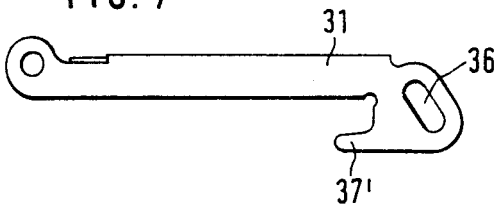
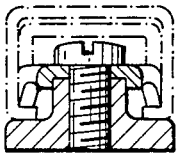
FIG. 8

FIG. 9
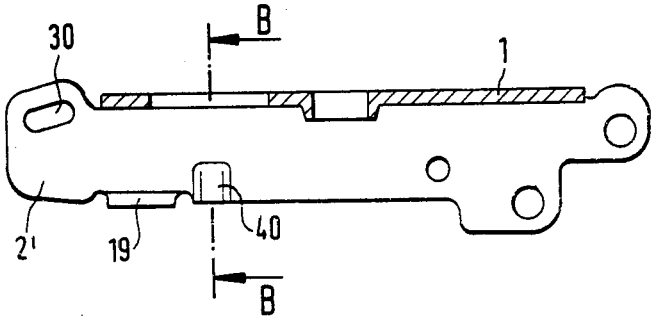
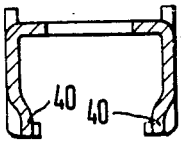
FIG. 10

HINGE BRACKET AND FASTENING PLATE ASSEMBLY FOR USE IN A FURNITURE HINGE

BACKGROUND OF THE INVENTION

1. Field of the Invention

This invention relates to a hinge bracket and fastening plate assembly for a furniture hinge, and more particularly to a hinge bracket and fastening plate assembly that provides a firm, backlash-free interconnection between a hinge bracket and a fastening plate.

2. Description of the Prior Art

Tracks for holding a hinge bracket and a base plate against a displacement in the transverse direction of the hinge bracket are known from Germany Utility Model Specification No. 74 32 793 and Published German Application No. 28 39 576. But in those known assemblies the hinge bracket is not interlocked with the fastening plate in a self-biasing manner and without backlash.

Published West German Application No. 33 45 063 and corresponding U.S. patent application Ser. No. 676,421, filed Nov. 29, 1984, and assigned to the same assignee as the present application, disclose a hinge bracket, which can be connected to a fastening plate by a simple, self-biasing snap lock. However, in that structure, lugs that extend at an angle from flanges of the hinge bracket must be moved over a relatively long distance in track grooves in a fastening plate until the hinge bracket contacts an additional guide means, which includes a slot formed in the fastening plate and which defines an opening that faces the hinge bracket in the direction in which the hinge bracket is inserted. The slot is contacted by the hinge bracket at an annular groove formed in an adjusting screw carried by the hinge bracket.

It is an object of the present invention to improve the hinge bracket fastening plate assembly described hereinbefore in such a manner that the hinge bracket can be moved in a simpler manner and more quickly to the position in which it releasably interlocks with the fastening plate.

SUMMARY OF THE INVENTION

Briefly stated, in accordance with one aspect of the present invention, a hinge bracket and fastening plate assembly for a furniture hinge is provided, the assembly including a fastening plate that is adapted to be secured to a furniture part, the fastening plate including a base plate having a pair of laterally spaced slide surfaces and a cover plate engageable with the base plate in an overlying relationship therewith. The cover plate includes first and second pairs of aligned flanges having edges positioned opposite and spaced from the slide surfaces to define track grooves therebetween. Each of the pairs of flanges are spaced from each other in a longitudinal direction to define between the flanges on one side of the cover plate, a pair of spaced, lateral recesses. The cover plate includes an abutment edge and a slot at opposite longitudinal ends thereof and is securely connected to the base plate by a suitable connecting means. A hinge bracket is provided and includes a substantially channel-shaped member having a pair of laterally spaced flanges, the flanges each including an inwardly extending lug. The lugs are positioned in opposed relationship and have a length in the longitudinal direction of the hinge bracket sufficient to permit the lugs to pass through the lateral recesses in the cover plate, and the lugs have a height selected to permit them to slide along the track grooves. Guide means are carried by the hinge bracket for guiding the hinge bracket in the longitudinal direction to permit sliding movement of the hinge bracket relative to the fastening means. A pivot pin extends between the flanges of the hinge bracket at one end thereof and pivotally carries a detent lever. The detent lever includes a curved cam face, the cam face being engageable with the abutment edge of the cover plate when the hinge bracket is assembled to the fastening plate, in order to firmly hold the hinge bracket in engagement with the fastening plate. Biasing means are provided for resiliently biasing the cam face into tight engagement with the abutment edge.

BRIEF DESCRIPTION OF THE DRAWINGS

FIG. 6 is a longitudinal sectional view showing another embodiment of a hinge bracket which is releasably and firmly locked to a fastening plate assembly.

FIG. 7 is a side elevation of an intermediate plate which is connected to the hinge bracket of FIG. 6.

FIG. 8 is a transverse sectional view taken on line A—A of FIG. 6.

FIG. 9 is a longitudinal sectional view of the hinge bracket of FIG. 6.

FIG. 10 is a transverse sectional view taken on line B—B of FIG. 9.

DESCRIPTION OF THE PREFERRED EMBODIMENTS

Figure 1:
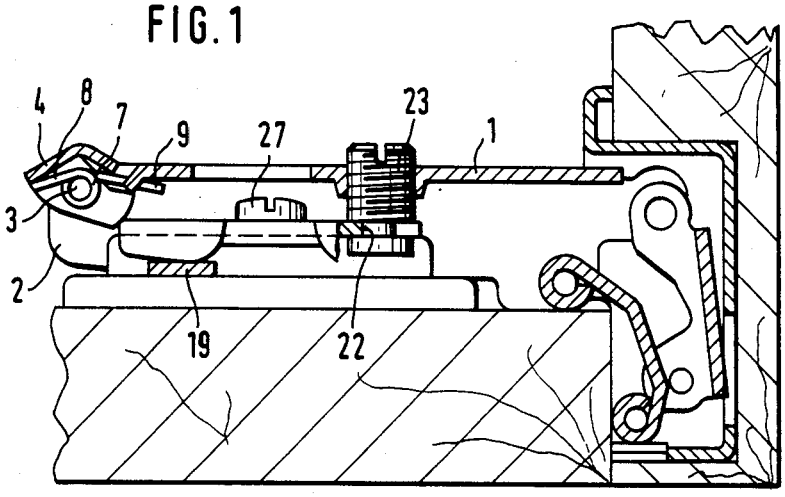
FIG. 1 is a longitudinal sectional view, partially broken away, showing a hinge bracket which is releasably and firmly locked to a fastening plate assembly.

Referring now to the drawings, and particularly to FIG. 1 thereof, there is shown a furniture hinge 52 that serves to hingedly connect a furniture body 50 with a door 51.

Figure 2:
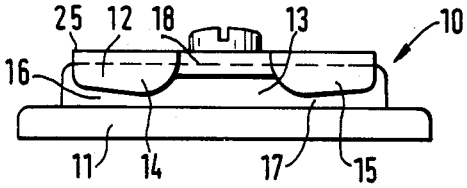
FIG. 2 is a side elevation showing the fastening plate assembly.
Figure 5:
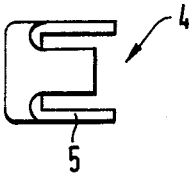
FIG. 5 is a top plan view showing the lever of FIG. 4.
Figure 3:
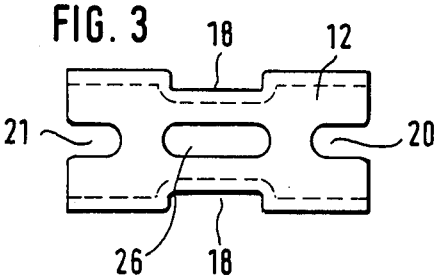
FIG. 3 is a top plan view showing the cover plate of the fastening plate assembly.

As best seen in FIGS. 1 through 3, the hinge includes a base plate 11, of generally rectangular form, and a centrally disposed pedestal 13, also of generally rectangular form, and having logitudinal edges thereof spaced inwardly from corresponding logitudinal edges of base plate 11 to define a pair of longitudinally extending slide surfaces **13*a* on respective longitudinal sides of the centrally disposed pedestal 13. A generally rectangular cover plate 12 is provided and is also of generally rectangular conformation. Cover plate 12 includes longitudinally extending flanges 14 at one longitudinal end thereof and longitudinally extending flanges 15 at the opposite logitudinal end thereof, each of the flanges extending downwardly from the lower surface of cover plate 12. Respective pairs of flanges 14 and 15 on the longitudinal sides of cover plate 12 are aligned, and the lateral spacing between respective flanges 14 and between respective flanges 15 is such as to permit cover plate 12 to overlie base plate 11 so that flanges 14, 15, extend downwardly along the longitudinal edges of centrally disposed pedestal 13. The lowermost surfaces of flanges 14 and 15 are spaced from the slide surfaces 13a of base plate 11 to define a pair of longitudinally extending track grooves 16 and 17 on respective longitudinal sides of the fastening plate 10, which is defined by the assembly of cover plate 12 and base plate 11 by means of connecting screw 27 as shown in FIG. 2. As best seen in FIG. 3, cover plate 12 includes a longitudinally extending, centrally positioned slot 26, through which the shank of screw 27 extends, in order to permit longitudinal adjustment between base plate 11 and cover plate 12**.

Referring to FIG. 3, cover plate 12 includes a pair of substantially centrally aligned, longitudinally extending slots 20 and 21 provided at respective longitudinal end thereof, and also includes a pair of lateral recesses 18 positioned between flanges 14 and 15 on each longitudinally extending side of cover plate 12. Lateral recesses 18 have a predetermined length in the longitudinal direction and also a predetermined width in the transverse direction of cover plate 12 for purposes to be explained hereinafter.

When fastening plate 10 has been assembled by connecting base plate 11 and cover plate 12, it is suitably secured to furniture body 50 by any convenient securing means, such as, for example, by screws, or the like.

A channel-shaped hinge bracket 1 is provided in overlying relationship to fastening plate 10. Hinge bracket 1 includes an elongated substantially planar central web portion **1*a* and a pair of laterally spaced, downwardly depending flanges 2 that have an interior spacing greater than the maximum lateral dimension of cover plate 12. At one end of hinge bracket 1 a pivot pin 3 is provided to extend between opposed flanges 2. Additionally, a set screw 23 is threadedly received in central web portion 1*a* of hinge bracket 1, and set screw 23 includes a head portion 23*a* and an annular groove 22. The inner diameter of groove 22 is so sized that it can be slidably received in slot 20 of cover plate 12. The end of hinge bracket 1 opposite from pivot pin 3 is connected to the remainder of hinge 52**.

A detent lever 4 is pivotally carried on pivot pin 3 and includes a central portion **4*a* and a pair of spaced, substantially parallel flanges 5 that depend from central portion 4a and that each include a bearing hole 6. Pivot pin 3 extends through bearing holes 6, and also carries a coiled torsion spring 7, one leg 8 of which is in contact with the inner surface of central portion 4*a* of detent lever 4. The other leg 9 of spring 7 is in contact with the lower surface of central web portion 1*a* of hinge bracket 1. Thus detent lever 4 is spring biased to pivot in a clockwise direction about pivot pin 3, as viewed in FIG. 1**.

Figure 4:
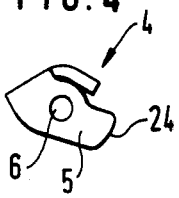
FIG. 4 is a side elevation showing the detent lever for effecting releasable interlock of the hinge bracket to the fastening plate assembly.

Detent lever 4 carries a pair of curved cam faces 24 that are formed on the outer surfaces of flanges 5 at points thereon that are on the opposite sides of bearing holes 6 from central portion **4*a*. Cam faces 24 have a center of curvature that is offset from the centers of bearing holes 6 so that cam faces 24 extend upwardly and outwardly, as viewed in FIG. 4, in an approximately spiral shape relative to the centers of bearing holes 6**.

Both base plate 11 and cover plate 12 are symmetrical with respect to their respective longitudinal and transverse axes so that the hinge bracket can be inserted into the fastening plate 10 from either end to permit both left and right hand mounting.

Hinge bracket 1 includes a pair of lugs 19 that are carried on the inner surfaces of respective flanges 2 and are in opposed relationship. Lugs 19 have a height that permits them to slide along track grooves 16 and 17 between the lowermost surfaces of flanges 14 and 15 and slide surfaces **13*a*, and have a length in the longitudinal direction of hinge bracket 1 that is approximately equal to or slightly less than the longitudinal length of lateral recesses 18, in order to permit lugs 19 to pass through recesses 18 in a direction perpendicular to the plane of fastening plate 10**.

In assembling hinge bracket 1 to fastening plate 10, lugs 19 are positioned above respective lateral recesses 18, and hinge bracket 1 is lowered so that lugs 19 lie between respective track guides 16 and 17, at which time annular groove 22 of set screw 23 will be spaced immediately outwardly from and adjacent to the outlet of slot 20. Hinge bracket 1 is then moved longitudinally so that annular groove 22 of set screw 23 slides along and is received within slot 20, and so that lugs 19 pass along track grooves 16. When hinge bracket 1 is initially placed in overlying relationship with fastening plate 10, flanges 5 of detent lever 4 contact the uppermost surface of fastening plate 10 and lever 4 is pivoted, in a counterclockwise direction as viewed in FIG. 1, against the biasing force provided by torsion spring 7. Cam surfaces 24 of flanges 5 slide along the upper surface of fastening plate 10 as hinge bracket 1 moves longitudinally. The positioning between detent lever 4 and set screw 23 is such that when annular groove 22 abuts the innermost surface of slot 20, detent lever 4 is so positioned that torsion spring 7 causes curved cam faces 24 to come into contact with abutment edges 25 of cover plate 12. The force of torsion spring 7 causes curved cam faces 24 to move against abutment edges 25 and thereby imparts a force to hinge bracket 1 to draw it in a longitudinal direction, toward the left as viewed in FIG. 1, in order to maintain annular groove 22 against the innermost end portion of slot 20, and thereby provide a tight, backlash-free interconnection between hinge bracket 1 and fastening plate 10.

Another embodiment of the present invention is illustrated in FIGS. 6 through 10. Referring to FIG. 6, the hinge structure 52 therein shown is generally similar to the previously described embodiment, but it differs from the embodiment of FIG. 1 in that an intermediate plate 31 is provided and is positioned between hinge bracket 1 and cover plate 12. Intermediate plate 31 is illustrated in FIGS. 7 and 8, and includes a longitudinally extending central web portion **31*a* and a pair of laterally spaced depending flanges 31b, the outermost longitudinal surfaces of which are spaced from each other by a distance slightly less than the spacing between the interior surfaces of flanges 2' of hinge bracket 1, to permit intermediate plate 3' to be received within hinge plate 1. Intermediate plate 31 includes a pair of elongated slots 36 at one end of each of flanges 31*b*, with slots 36 being inclined at an acute angle relative to central web portion 31*a*. At the opposite end of intermediate plate 31 a pair of axially aligned circular bearing bores 31*c* are provided in flanges 31*b* to permit intermediate plate 31 to be pivotally carried by a pivot pin 3'. As best seen in FIG. 9, pivot pin 3' extends through a pair of oblique slots 30 that are formed in flanges 2' at one end of hinge bracket 1, and slots 30 are inclined at an acute angle relative to the plane of the central web portion 1*a* of hinge bracket 1, and in a direction opposite to the direction of inclination of slots 36 in intermediate plate 31**.

Referring once again to FIG. 6, hinge bracket 1 carries an adjusting screw 33, that includes an annular groove defined between head 35 and the threaded body of adjusting screw 33, and a spring ring 31 is provided to draw intermediate plate 31 tightly against the undersurface of hinge bracket 1 when the two members are assembled, as illustrated in FIG. 6. Hinge bracket 1 carries a pair of inwardly extending pins 37 that extend from flanges 2' in opposed relationship and are received in slots 36 of intermediate plate 31.

Referring now to FIG. 7, intermediate plate 31 includes a pair of hook-like projections 37', that extend in a longitudinal direction from respective flanges 31*b*. Projections 37' are adapted to engage with the lowermost surfaces of flanges 15 of cover plate 12 (see FIG. 6) and to extend into track grooves 17 to define stops to limit longitudinal movement of plate 31 relative to cover plate 12.

As shown in FIG. 9, hinge bracket 1 includes a pair of opposed lugs 19 that extend inwardly from flanges 2', and a pair of inwardly extending projections 40 are provided on the innermost surfaces of each of flanges 2' and adjacent to respective lugs 19 to prevent lugs 19 from moving beyond recesses 18 into opposite track grooves 17 when it is desired to disassemble the hinge structure.

The structure of and connection between hinge bracket 1, intermediate plate 31, and cover plate 12 is described in more detail in published German Application No. 34 42 421, and in corresponding U.S. patent application Ser. No. 755,798, filed July 17, 1985, the disclosure of which is hereby incorporated herein by reference.

The operation of the embodiment illustrated in FIGS. 6 through 10 is similar to that of the embodiment of FIGS. 1 through 5 except that hook-like projections 37' define and provide an additional guiding and stop means for guiding and stopping longitudinal movement of hinge bracket 1 relative to cover plate 12. After a short longitudinal displacement, as in the previously-described embodiment, detent lever 4 performs a snap action movement so that its cam faces 24 engage respective abutment edges 25 on cover plate 12 to tightly retain intermediate plate 31 in position with respect to cover plate 12.

Adjusting screw 33 can be turned to cause a longitudinal displacement of the central web of hinge bracket 1 relative to the central web of intermediate plate 31, by virtue of the inclination of slots 30 and 36, to such a position that in response to a pivotal movement of door 51 hinge bracket 1 will be moved to such an extent that the change of the gap between door 51 and body 50 of the furniture will be compensated by a corresponding lateral displacement of the door as a result of the accompanying pivotal movement of the hinge bracket relative to the intermediate bracket.

Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. A hinge bracket and fastening plate assembly for a furniture hinge, said assembly comprising:

(a) a fastening plate adapted to be secured to a furniture part, said fastening plate including a base plate having a pair of laterally spaced slide surfaces, and a cover plate engageable with said base plate and in overlying relationship therewith, said cover plate including a pair of flanges extending in a longitudinal direction and having edges positioned opposite and spaced from said slide surfaces to define track grooves therebetween, a pair of lateral recesses in said cover plate adjacent said flanges, said cover plate including an abutment edge and a slot at an opposite longitudinal end of said cover plate from said abutment edge, and connecting means for securely connecting said cover plate to said base plate;

(b) a hinge bracket including a substantially channel-shaped member having a pair of laterally spaced flanges, said flanges each including an inwardly extending lug, said lugs positioned in opposed relationship and having a length in the longitudinal direction of said hinge bracket to permit said lugs to pass through said lateral recesses in said cover plate and having a height to permit said lugs to slide along said track grooves, and guide means carried by said hinge bracket, for guiding said hinge bracket in a longitudinal direction to permit sliding movement of said hinge bracket relative to said fastening means, and a pivot pin extending between said flanges at one end of said hinge bracket; and (c) a detent lever pivotally carried on said pivot pin of said hinge bracket, said detent lever including a curved cam face, said cam face engageable with said abutment edge when said hinge bracket is assembled to said fastening plate to firmly hold said hinge bracket in position on said fastening plate, and biasing means for resiliently biasing said cam face of said lever into tight engagement with said abutment edge.

2. A hinge bracket and fastening plate assembly according to claim 1, including an intermediate plate connected to said hinge bracket on a surface opposite to said cover plate, said intermediate plate including hook-like projections slidably received in said track grooves.

3. A hinge bracket and fastening plate assembly according to claim 1, wherein said hinge bracket includes at least one inwardly extending projection on a flange and adjacent one of said lugs to prevent said lugs from moving beyond the lateral recesses of said cover plate by engagement of said projection with one of said flanges of said cover plate.

4. A hinge bracket and fastening plate assembly in accordance with claim 1, wherein said lateral recesses are formed in a cover plate which is symmetrical with respect to its longitudinal and transverse axes.

5. A hinge bracket and fastening plate assembly in accordance with claim 1, wherein said guide means includes a set screw carried by said hinge bracket, said set screw including an annular groove, and a longitudinally extending slot formed at one longitudinal end of said cover plate, said slot slidably receiving the annular groove of said set screw for guiding the movement of said hinge bracket relative to said cover plate.

* * * * *